US007594522B2

(12) United States Patent
Binder

(10) Patent No.: US 7,594,522 B2
(45) Date of Patent: Sep. 29, 2009

(54) SHAFT TRANSMISSION FOR A WEAVING MACHINE

(75) Inventor: Bernd Binder, Albstadt (DE)

(73) Assignee: Groz-Beckert KG, Albstadt (DE)

( * ) Notice: Subject to any disclaimer, the term of this patent is extended or adjusted under 35 U.S.C. 154(b) by 7 days.

(21) Appl. No.: 11/907,035

(22) Filed: Oct. 9, 2007

(65) Prior Publication Data

US 2008/0083472 A1 Apr. 10, 2008

(30) Foreign Application Priority Data

Oct. 6, 2006 (EP) ..... 06021001

(51) Int. Cl.
*D03D 51/02* (2006.01)
*D03D 51/14* (2006.01)
*D03D 49/60* (2006.01)
*D03D 23/00* (2006.01)

(52) U.S. Cl. ..... 139/55.1; 139/1 E

(58) Field of Classification Search ..... 74/333, 74/423; 139/1 E, 55.1; 192/90, 94
See application file for complete search history.

(56) References Cited

U.S. PATENT DOCUMENTS 2,022,225 A * 11/1935 Thompson ..... 139/18
2,085,507 A * 6/1937 Monier ..... 139/4
2,087,449 A * 7/1937 Rice et al. ..... 139/37
2,186,814 A * 1/1940 Adams ..... 66/125 R
2,437,379 A * 3/1948 Clark ..... 139/46
2,631,616 A * 3/1953 Auty ..... 139/180
2,633,874 A * 4/1953 Hewton ..... 139/56
2,639,732 A * 5/1953 Moessinger ..... 139/1 E
2,687,148 A * 8/1954 Pfarrwaller ..... 139/58
2,819,734 A * 1/1958 Pfarrwaller ..... 139/110
3,192,957 A * 7/1965 O'Neill ..... 139/55.1
3,466,896 A * 9/1969 Pfarrwaller ..... 464/91
3,580,012 A * 5/1971 Voisin et al. ..... 66/55
3,603,351 A * 9/1971 Piazzolla et al. ..... 139/79
3,695,304 A 10/1972 Menegatto
3,753,451 A * 8/1973 Hosono et al. ..... 139/110
4,344,304 A * 8/1982 Eiche ..... 464/85
4,448,220 A * 5/1984 Zwiener et al. ..... 139/1 E
4,518,020 A * 5/1985 Speich ..... 139/55.1

(Continued)

FOREIGN PATENT DOCUMENTS

DE 1 535 221 7/1970

(Continued)

*Primary Examiner*—Bobby H Muromoto, Jr.
(74) *Attorney, Agent, or Firm*—Fitch, Even, Tabin & Flannery; Norman N. Kunitz

(57) ABSTRACT

A shaft transmission (3) for a weaving machine comprises a shaft arrangement (8) that supports, on one end, a crown wheel (10) in order to drive the shaft arrangement (8), which is supported by two bearing arrangements (12, 13), between which a package (28) comprising the cam disks (**29-29*i*) is non-torsionally held on the shaft arrangement (8). The part (18) of the shaft arrangement (8), which supports the package (28), is connected with the remaining part (17) of the shaft arrangement (8) via a clutch arrangement (19), and is secured, in connected state, by a locking arrangement (41) that is actuated from one end of the shaft arrangement (8). For disassembly and replacement of the package (28), the connection can be released and the cam disk section (18) can be removed from the shaft transmission (3), while the drive section (17) remains in the shaft transmission (3**).

9 Claims, 5 Drawing Sheets

U.S. PATENT DOCUMENTS 4,537,226 A * 8/1985 Gotoh ..... 139/100
4,850,399 A * 7/1989 Linka et al. ..... 139/436
4,875,565 A * 10/1989 Depoli ..... 192/48.2
4,878,392 A * 11/1989 Jaeger et al. ..... 74/333
5,642,757 A * 7/1997 Froment et al. ..... 139/1 E
6,186,184 B1 * 2/2001 Eberhard ..... 139/1 E

FOREIGN PATENT DOCUMENTS

WO WO 2005/098108 A 10/2005

* cited by examiner

SHAFT TRANSMISSION FOR A WEAVING MACHINE

CROSS REFERENCE TO RELATED APPLICATION

This application claims the priority of European Patent Application No. 06 021 001.0, filed on Oct. 6, 2006, the subject matter of which, in its entirety, is incorporated herein by reference.

BACKGROUND OF THE INVENTION

The invention relates to a shaft transmission for a weaving machine.

Shaft transmissions, also referred to as "eccentric machines", are used for driving the heald shafts of weaving machines. The shaft transmission has the task of deriving several different back-and-forth movements from the uniform rotation of a shaft in order to drive the heald shafts.

In conjunction with this, document WO 2005/098108 A1 has disclosed a shaft transmission that comprises a transmission frame with a rotatably supported shaft that bears several cam disks. These cam disks are associated with cam disk followers that actuate rockers. Connected to the rockers is a rod assembly used for the transmission of the drive motion to the respective heald shaft. The shaft is driven, via a bevel gear transmission consisting of a crown wheel and a conical wheel, by a drive shaft that is connected to a drive motor.

The form of each cam disk defines the form of the rockers of the associate heald shaft. Occasionally, the issue of changing the form of motion arises. In order to resolve this, the cam disks need to be replaced.

Regarding this, the aforementioned document suggests to provide the shaft, on its end away from the bevel gear transmission, with a removable end-piece that is supported in a support arrangement, which, in turn is detachably held by the transmission frame. If the cam disks are to be exchanged, the support arrangement is detached from the transmission frame. In addition, the end-piece is released from the shaft. Thereafter, the unit consisting of the end-piece and the support arrangement can be removed, thus leaving a narrow gap between the free end of the shaft and the transmission frame. Through said gap, individual cam disks pulled off the shaft in axial direction can be removed from the transmission frame and, conversely, the new cam disks can be mounted on the shaft.

This technical solution requires the disassembly of the cam disk package held on the shaft.

It is the object of the invention to simplify changing of the cam disks.

SUMMARY OF THE INVENTION

The above object is generally achieved with the shaft transmission in accordance with claim 1, the invention which comprises a transmission frame, a shaft arrangement that is rotatably supported in the transmission frame and has at least one cam support section and one drive section, whereby these sections can be separated from each other. At least one cam disk that is held on the first cam support section and a gear mechanism that comprises at least two gear wheels coming in meshing engagement with each other are provided, with one of the gear wheels being non-torsionally connected with the drive section (17) of the shaft arrangement (8), and the other gear wheel being non-torsionally connected with the drive shaft (6).

The shaft transmission in accordance with the invention uses as the shaft for at least one, preferably several, cam disks a shaft arrangement which can also be viewed as a divided shaft. Consequently, the shaft is divided into a cam support section and a drive section, which, when in operative state, are connected at a separating site, for example, by means of a suitable clutch arrangement, in a non-torsional manner and preferably exhibiting flexural strength. If one or more cam disks are to be replaced, the cam support section and the drive section of the shaft arrangement are separated from each other. While the cam support section and the cam disks can be removed from the transmission frame, the drive section may remain in the shaft transmission. Therefore, the gears of the gear mechanism remain meshed. Following reassembly, the existing gear play of the gears that needs to be maintained in a highly precise manner does not need to be readjusted.

With the removal of the cam support section from the transmission frame sufficient free space is created in order to be able to remove the package consisting of the cam disks and, optionally additional elements, and thus replace it with another package. Also, if needed, individual cam disks of this package may be replaced.

Referring to the present solution of the technical problem, the separation of the shaft arrangement at a point of the torque transfer path between the package consisting of the cam disks and the gear mechanism has been suggested. This provides an easily executable option for changing the cam disks, without requiring any disassembly of the gear mechanism. Cam disks need not be replaced individually, but may be replaced as a group, thus substantially reducing assembly times.

Preferably, several cam disks forming a package are provided, said package being detachably connected with the cam support section. For example, the cam disks may be seated on a bushing that can be shifted in axial direction with the cam support section but is non-torsionally connected thereto. During disassembly, the cam support section can be pulled in axial direction out of the cam disk package, whereupon the cam disks, or the package consisting of the cam disks, can be laterally removed from the installation space.

The drive section of the shaft arrangement is preferably associated with at least one bearing arrangement located between the separating site and the gearwheel. This bearing arrangement holds the drive section in the transmission frame, while the cam support section and the cam disks may have been removed from the transmission frame. Preferably, the drive section merely forms a short shaft butt-end that projects only minimally, or not at all, beyond the bearing arrangement. The separating site or clutch arrangement is preferably located directly next to the bearing arrangement which is located between the cam disk package and the gearwheel. Thus, by removing the cam disk section, the free space between the two bearing arrangements can be freed along the entire length of the cam disk package.

Preferably, the cam support section is held so as to be movable in axial direction in a bearing arrangement. The axial position of the shaft arrangement is preferably defined by the bearing arrangement between the cam disk and the gearwheel. Upon releasing the separating point between the cam support section and the drive section, the cam support section can be pulled out of its bearing arrangement in axial direction. Disassembly and assembly of the cam arrangement is particularly easy.

In order to connect the cam support section with the drive section, there is preferably provided a clutch arrangement which may be configured as a friction clutch and/or as a positive clutch. For example, the clutch arrangement may be a play-free friction clutch, e.g., configured as a cone clutch. A clamping screw or another suitable clamping means can be used to secure the cam support section and the drive section next in place to each other and thus hold the clutch arrangement in engaged state. A suitable push-type ejection means permits the separation of the conical connection as desired. Alternatively, the clutch arrangement may be configured as a positive denture clutch.

Additional details of advantageous embodiments of the invention are obvious from the subclaims, the drawings and/or the description.

The drawings show exemplary embodiments of the invention.

DETAILED DESCRIPTION OF THE INVENTION

Figure 1:
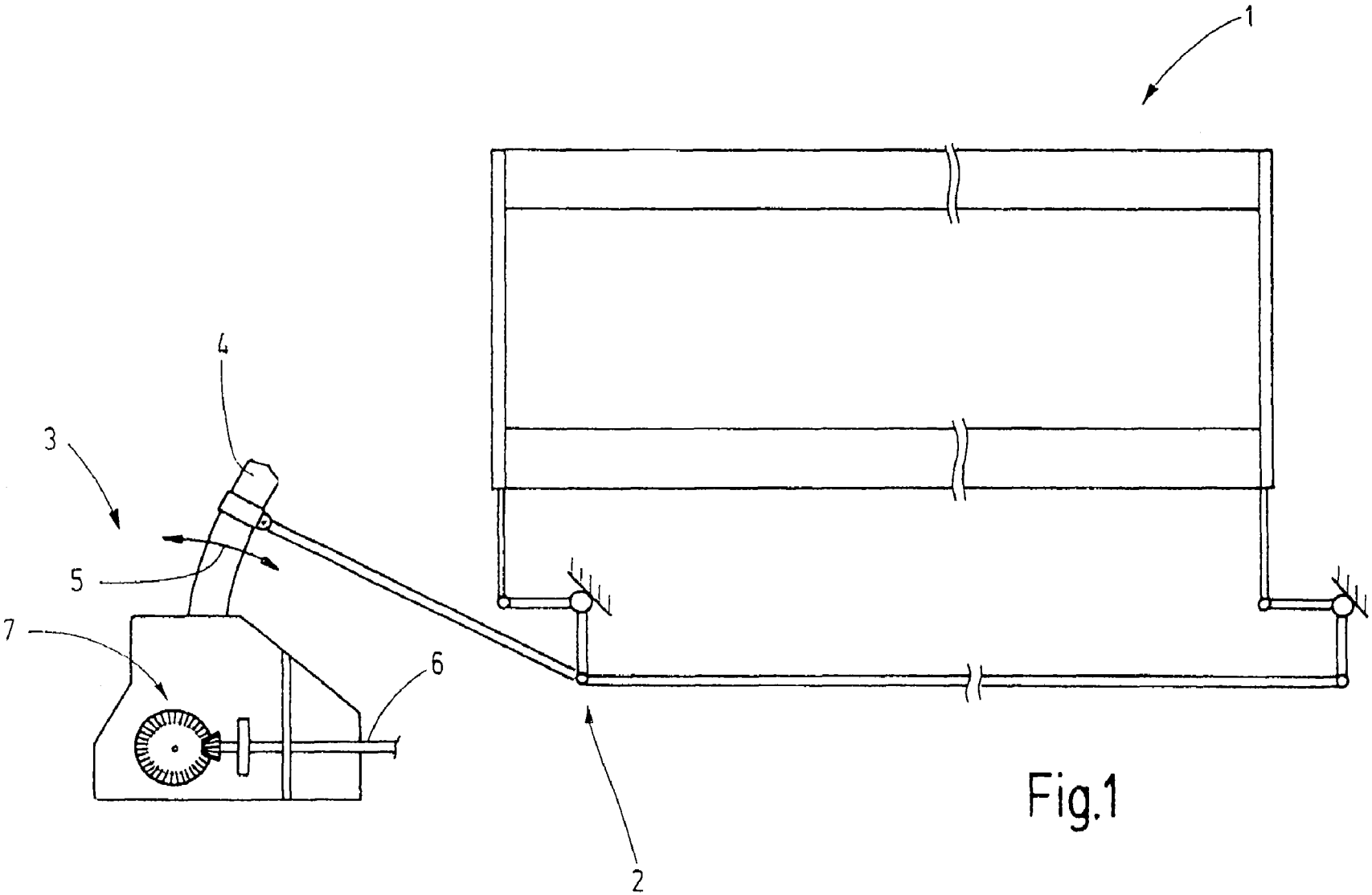
FIG. 1 is a schematic illustration of a heald shaft with drive rod assembly and shaft transmission.
Figure 2:
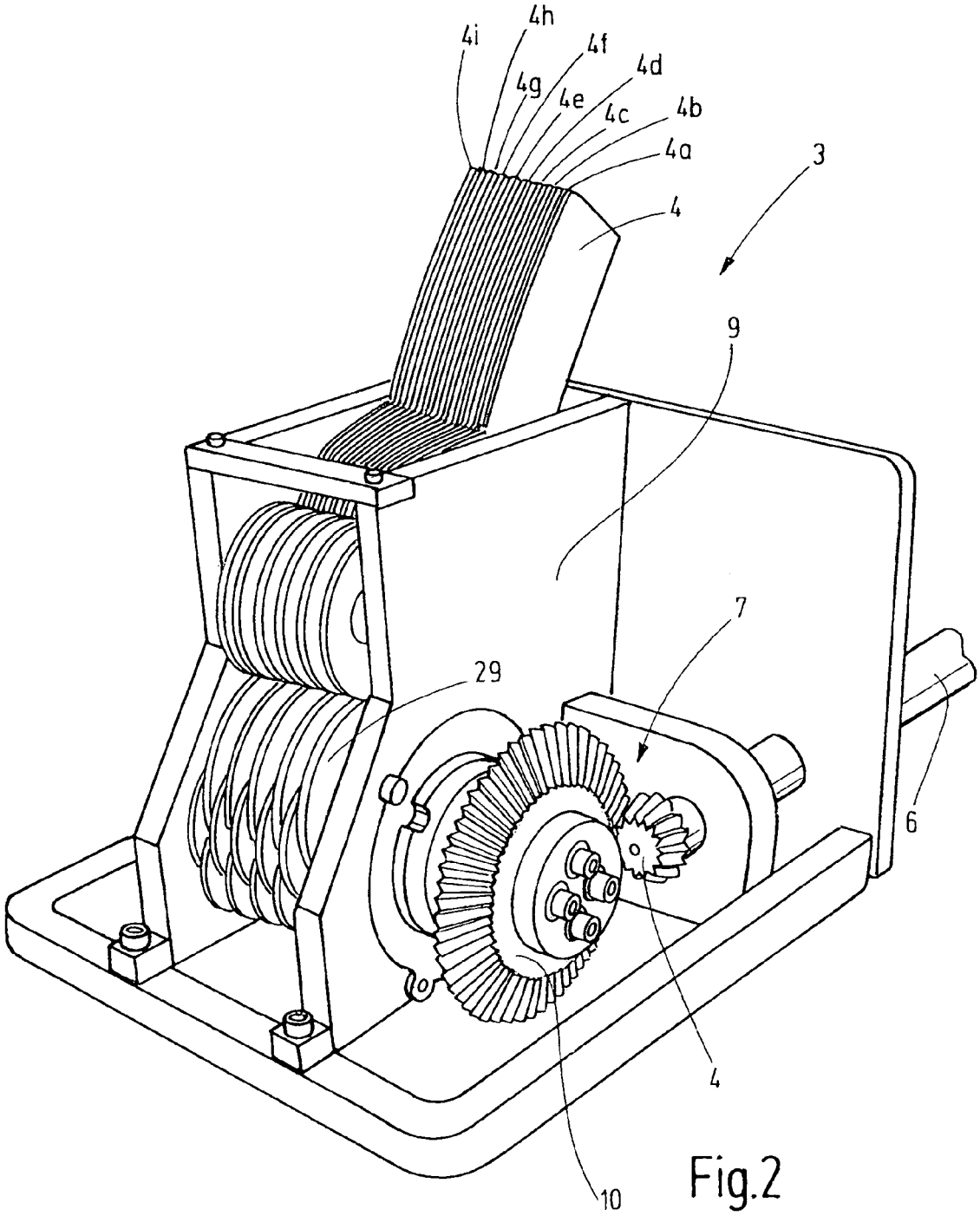
FIG. 2 is a perspective illustration of the shaft transmission in accordance with FIG. 1, with the hood removed.

FIG. 1 illustrates an arrangement that is associated with a weaving machine and consists of a heald shaft 1, a rod assembly 2 disposed to drive said shaft, and of a shaft transmission 3. The shaft transmission 3 has a rocker 4 for each heald shaft that is to be driven, said rocker, as is indicated by the arrow 5, performing a rocking back-and-forth motion that is transmitted to the heald shaft 1 via the rod assembly 2. The shaft transmission 3 derives this rocking motion from the uniformly rotating motion of a drive shaft 6 that is connected with an electric motor that is not further illustrated. The electric motor may be a separate motor that only drives the shaft transmission 3 or the main drive of the weaving machine. As is also obvious from FIG. 2, said motor drives a shaft arrangement 8 via a gear mechanism 7, for example, as in FIG. 3. The drive shaft 6 and the shaft arrangement 8 are rotatably supported in a transmission frame 9, as is illustrated with the hood removed by FIG. 2.

The gear mechanism 7 is configured as a bevel gear transmission. It has a crown wheel 10 that is non-torsionally connected with the shaft arrangement 8. Said crown wheel meshes with a pinion 11 that is non-torsionally connected with the drive shaft 6.

Preferably two bearing arrangements 12, 13 are provided for supporting the shaft arrangement 8. These bearing arrangements are preferably configured as rolling bearings that are arranged in appropriate walls 14, 15 of the transmission frame 9, said walls preferably being aligned parallel to each other. The bearing arrangement 12 is preferably configured as a ball bearing, while the bearing arrangement 13 may preferably be a needle or roller bearing. Whereas the bearing arrangement 14 in the essentially flat wall 15 may be arranged so as to terminate flush on both sides, the wall 14 has a tubular flange 16 preferably projecting in the direction toward the crown wheel 10, said tubular flange bearing on its end facing the crown wheel 10 the ball bearing of the bearing arrangement 12. In so doing, the bearing arrangement 12 secures the axial position of the shaft arrangement 8 and thus of the crown wheel 10 and, therefore, defines the gear play of the gear mechanism 7.

Figure 3:
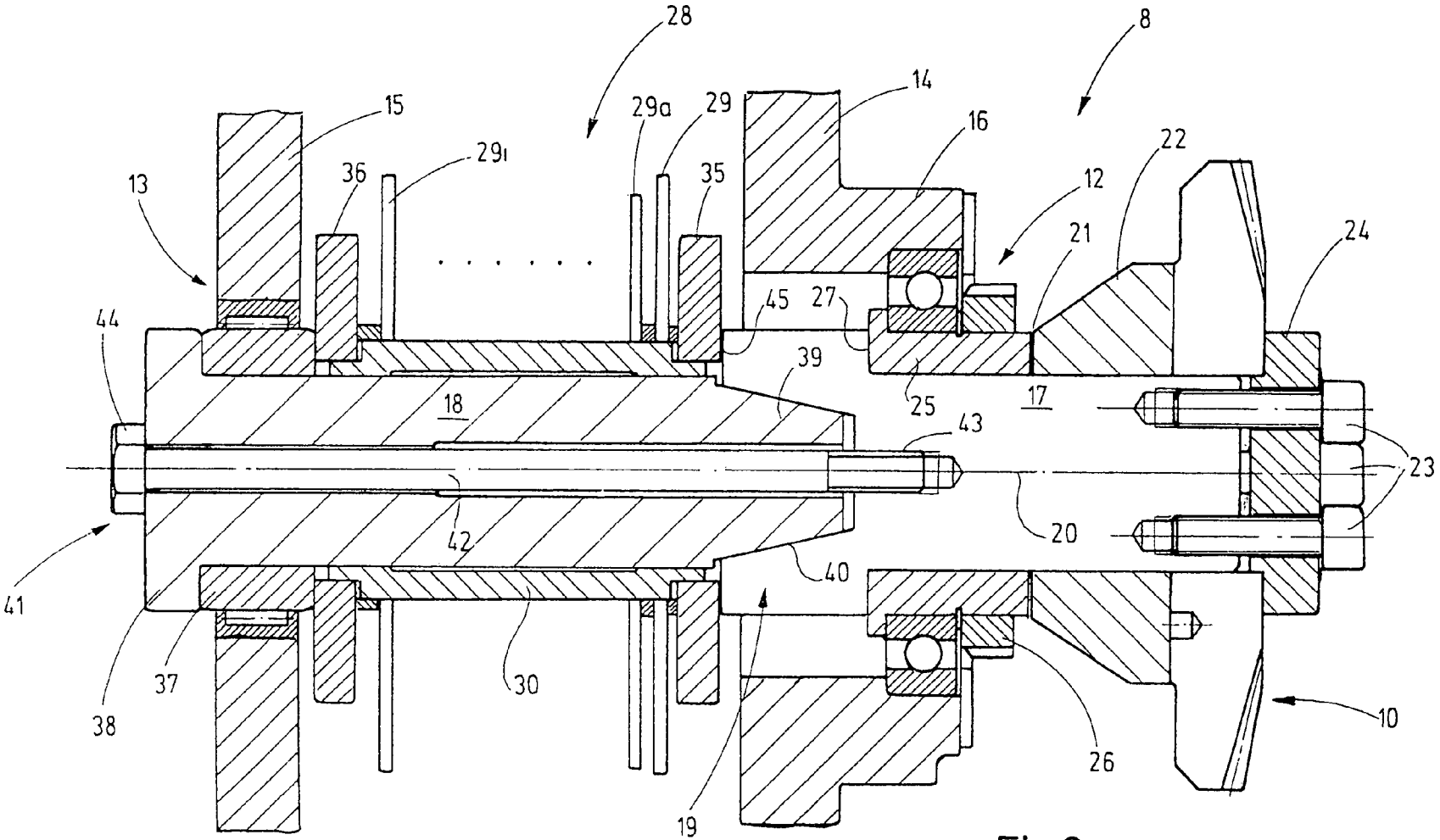
FIG. 3 is a longitudinal section of a first embodiment of a shaft arrangement associated with the shaft transmission in accordance with FIG. 2.

As illustrated by FIG. 3 with reference to an example, the shaft arrangement 8 is divided. Said arrangement comprises a drive section 17 and a cam support section 18, which, in operative state, are connected to each other in a non-torsional, non-bendable and axially rigid manner via a clutch arrangement 19, whereby both are arranged coaxially with respect to an axis of rotation 20 defined by the bearing arrangements 12, 13.

The drive section 17 is screwed to the crown wheel 10. As shown by FIG. 3, this is achieved with the use of washers 21, a locating cone 22, several screws 23 and a clamping element 24. Said elements are used to non-torsionally clamp the crown wheel 10 to the drive section 17. In so doing, a pressure sleeve 25 supports on its outside circumferential surface the ball bearing of the bearing arrangement 12, whereby the internal ring of the latter is accommodated between a radial flange of the pressure sleeve 25 and a screw ring 26 seated on the outside of the pressure sleeve 25. The pressure sleeve 25 finds its axial abutment against a corresponding shoulder 27 of the drive section 17.

Figure 5:
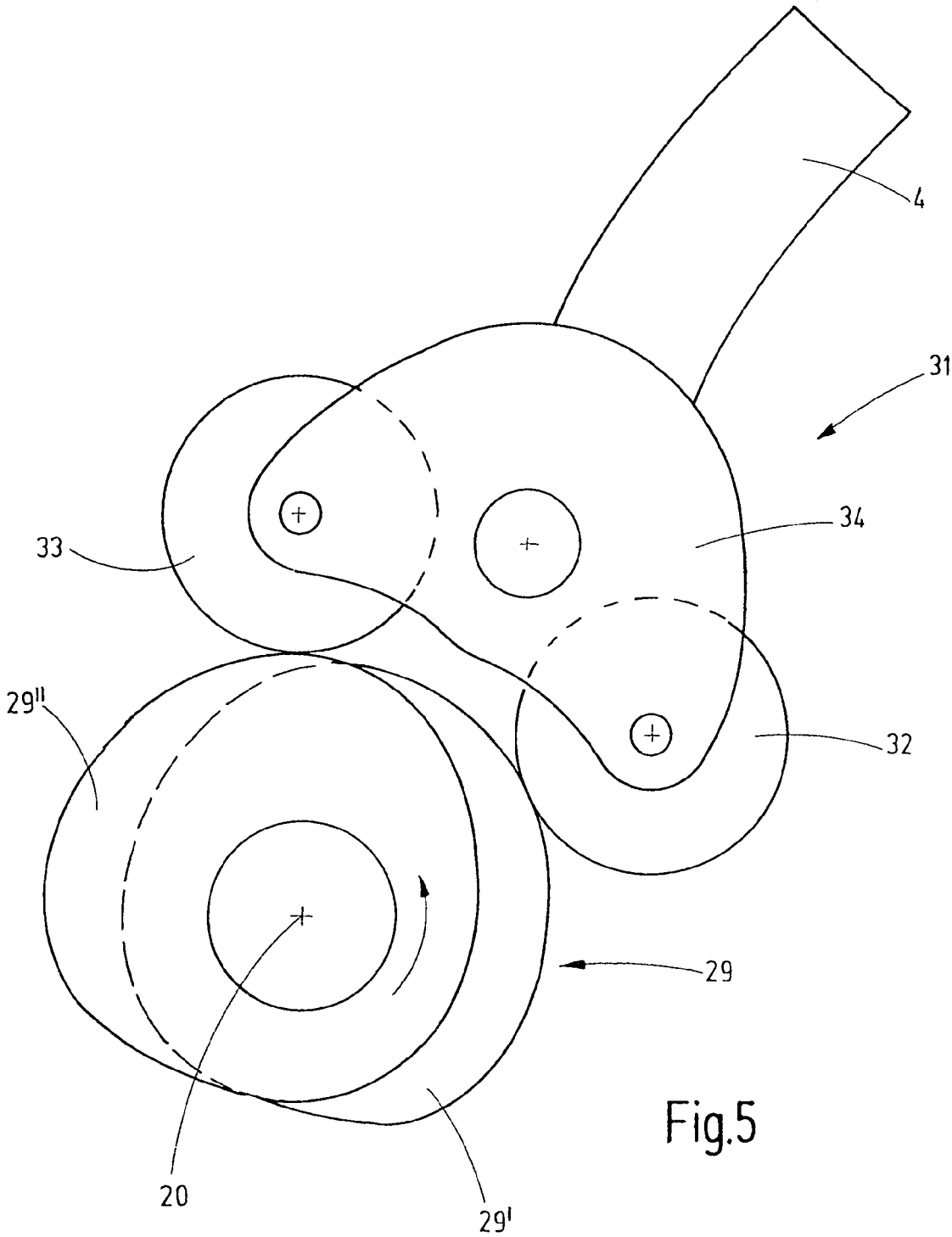
FIG. 5 is a schematic side elevation of a transmission arrangement consisting of a cam disk and disk followers in order to drive a rocker.

The cam support section 18 of the shaft arrangement 8 supports on its outside circumferential surface a package 28 of at least one, preferably several, cam disks 29 to **29*i*, whereby these may be seated on a common support sleeve 30 in order to form a package. These cam disks are disposed to drive the rocker 4, as well as the additional rockers 4*a* through 4*l*. With the exception of the optionally individual form of the cam disks 29 or 29*a* through 29*i*, the transmission arrangements consisting of the respective cam disks 29 through 29*i* and the rockers 4 through 4*l* are analogous. FIG. 5 illustrates such a transmission arrangement 31 with reference to the example of the rocker 4 and the cam disk 29. The cam disk 29, which consists of two complementary disks 29', 29", is associated with two cam followers 32, 33 having the form of rollers whose parallel axes of rotation are supported on a rocker 34 and roll off the non-circular outside circumferential surface of the cam disk 29. This cam disk rotates about the axis of rotation 20 that is oriented parallel to the axes of rotation of the cam followers 32, 33. Attached to the jack 34 is the rocker 4 that performs a rocking motion corresponding to the radial displacement movement of the cam followers 32, 33 when the cam disk 29** is rotating.

As shown by FIG. 3, the package 28 is seated between two disks 35, 36 mounted to the support sleeve 30. The cam disks 29 through **29*i* may additionally be connected to the support sleeve in fixed positions of rotation. To do so, the cam disks 29 through 29*i* can be positioned relative to each other by index bolts or other alignment means. In addition, said disks can be secured—by a denticulation profile, by index bolts or by other means—in a fixed position of rotation relative to the support sleeve 30. In turn, the support sleeve 30 may be secured in a non-torsional manner on the cam support section 18** by using suitable means such as, for example, a tongue and groove connection, a denticulation profile, a clamping screw, a pin connection or the like.

The cam support section 18 of the shaft arrangement 8 is preferably a shaft with a central hollow-drilled shaft which extends through the bearing arrangement 13. This section may bear an internal ring 37, whereby the roller elements of the bearing arrangement 13 roll on said internal ring's exterior circumference. The internal ring 37 can be seated with minimal or no play, however in an axially shiftable manner, on the cam support section 18 and come into abutment with a radial collar 38 of the cam support section 18.

The other end of the cam support section 18 is connected to the drive section 17. To do so, said end is preferably conical, so that a cone 39 is formed. This cone fits into a conical cutout 40 on the end of the drive section 17, said end being located away from the crown wheel 10 and—viewed from the perspective of the crown wheel—beyond the bearing arrangement 12. The cone 39 and the cutout 40 are arranged coaxially relative to the axis of rotation 20 and form the clutch arrangement 19 that is configured as a cone clutch or as a tapered shaft connection. In engaged state, it results in a non-torsional and non-bendable connection of the drive section 17 and the cam support section 18 to each other. The cone clutch has the advantage that it can be connected, i.e., engaged, in any position of rotation of the drive section 17 relative to the cam support section 18. If a specific position of rotation is to be pre-specified, it is also possible to provide a positive connection, which permits engagement only in a specific position of rotation.

In order to secure the cam support section 18 and the drive section 17 to each other a suitable locking means 41, for example, in the form of a locking bolt 42 may be provided, said bolt extending through the central bore of the cam support section 18 and into a tapped blind hole 43. The bolt 42 is tightened in the tapped blind hole 43 so that said bolt's head 44 exerts an axial pressure on the cam support section 18, thereby clamping the cone 39 in place in the cutout 40.

The embodiment in accordance with FIG. 3 requires that the distance between the internal shoulder of the radial collar 38 and the end 45 of the drive section 17 correspond to the width of the package 28 and the width of the disks 35 and 36 and to the width of the internal ring 37, so that the bolt 42 may clamp these components to each other. This is required when only one positive engagement exists between the cam disks 29 and the support sleeve 30, i.e., then the cam disks 29 are slipped onto the support sleeve 30 without play. At the same time, the bolt 42 clamps the cam support section 18 with the drive section 17—and thus the cam package 28—in place.

Figure 4:
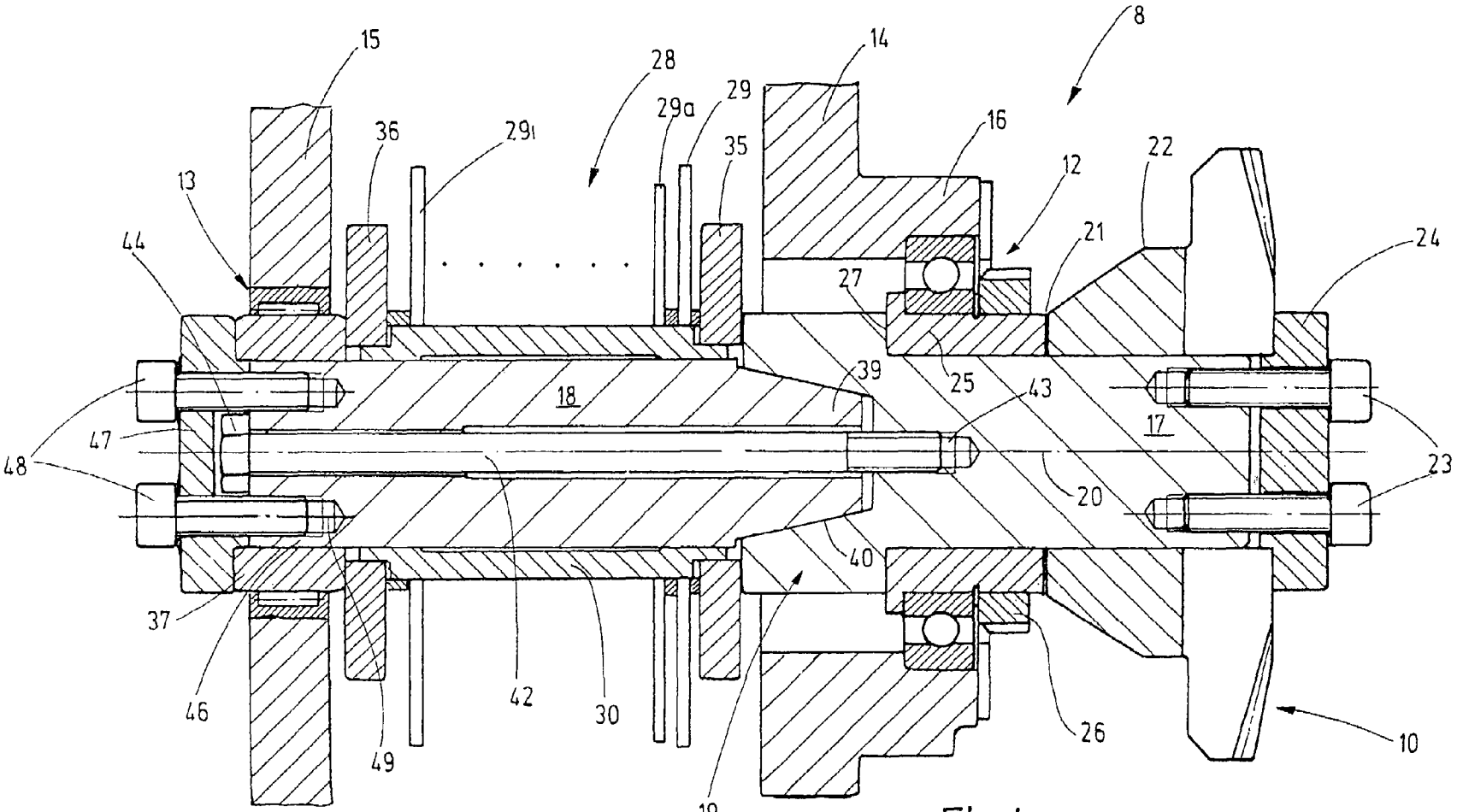
FIG. 4 is a longitudinal section of a second embodiment of a shaft arrangement for the shaft transmission in accordance with FIG. 2.

Alternatively, as illustrated by FIG. 4, the end 46 of the cam support section 18 may terminate inside the internal ring 37. Thus, said ring does not have a radial collar 38. A clamping disk 47 is used to clamp the cam package 26 in place between the disks 35 and 36 and the internal ring 37. To do so, said clamping disk is fixed, with the use of mounting means 48, in the tapped holes 49 of the cam support section 18. Apart from this, the above description applies accordingly while reference is made to the same reference numbers.

The in-so-far described shaft transmission 3 operates as follows:

During operation, the drive shaft 6 rotates the shaft arrangement 8 via the gear mechanism 7 and, with said shaft arrangement, the cam disks 29 through 29*i*. Accordingly, the rockers 4 through 4*i* perform rocking motions that are transmitted to the corresponding heald shafts.

If the motion of one or more heald shafts is to be changed, the package 28 is exchanged. To so, the machine is stopped and the hood of the shaft transmission 3 is removed. Thereafter, the bolt 44 is released. If the cone 39 should become stuck in the cutout 40, it is loosened. This is done with a suitable push-type ejection means. For example, the through-bore of the cam support section 18 may be provided with an internal thread into which a bolt may be screwed, said bolt coming into abutment with the tapered smooth end at the bottom of the tapped blind hole 43. Alternatively, push-type ejection screws may be inserted into one or more tapped holes that extend parallel to the central bore through the cam support section 18. Additional options for releasing a conical connection are familiar to the person skilled in the art.

After releasing the conical connection and thus the clutch arrangement 19, the cam support section 18 can be pulled axially out of the bearing arrangement 13. As a result of this, the package 28 is freed and can be laterally moved in one piece out of the intermediate space between the walls 14, 15.

Referring to the exemplary embodiment illustrated by FIG. 3, the clutch arrangement 19 in the space, which is enclosed by the tubular flange 16, is arranged between the package 28 and the crown wheel 10 outside the space enclosed by the package 29. In so doing, the clutch arrangement 19 is preferably located, as illustrated, between the bearing arrangement 12 and the package 28.

A shaft transmission 3 for a weaving machine comprises a shaft arrangement 8 that supports, on one end, a crown wheel 10 in order to drive the shaft arrangement 8. The shaft arrangement 8 is supported by means of two bearing arrangements 12, 13, between which a package 28 comprising the cam disks 29 through 29*i* is non-torsionally held on the shaft arrangement 8. The part 18 of the shaft arrangement 8, which supports the package 28, is connected with the remaining part 17 of the shaft arrangement 8 via a clutch arrangement 19 that represents a separating point. The clutch arrangement 19 is configured, e.g., as a frictional clutch with a cone 39 and an appropriate cutout 40, and is secured, in connected state, by means of a locking means 41 that is to be actuated from one end of the shaft arrangement 8. For disassembly and replacement of the package 28, the connection can be released and the cam disk section 18 can be removed from the shaft transmission 3, while the drive section 17 remains in the shaft transmission 3. Consequently, the package 28 can be exchanged as a whole, without requiring the disassembly of the gear drive that drives the shaft arrangement 8.

It will be appreciated that the above description of the present invention is susceptible to various modifications, changes and adaptations, and the same are intended to be comprehended within the meaning and range of equivalents of the appended claims.

LIST OF REFERENCE NUMBERS

| | |
|---|---|
| 1 | Heald shaft |
| 2 | Rod assembly |
| 3 | Shaft transmission |
| 4 | Rocker . . . 4i |
| 5 | Arrow |
| 6 | Drive shaft |
| 7 | Gear drive |
| 8 | Shaft arrangement |
| 9 | Transmission frame |
| 10 | Crown wheel |
| 11 | Pinion |
| 12 | Bearing arrangement |
| 13 | Bearing arrangement |
| 14 | Wall |
| 15 | Wall |
| 16 | Tubular flange |
| 17 | Drive section |
| 18 | Cam support section |
| 19 | Clutch arrangement |
| 20 | Axis of rotation |
| 21 | Washers |
| 22 | Locating cone |
| 23 | Screws |
| 24 | Clamping element |
| 25 | Pressure sleeve |
| 26 | Screw ring |
| 27 | Shoulder |
| 28 | Package |
| 29 | Disk cam . . . 29i |

-continued

| | |
|---|---|
| 30 | Support sleeve |
| 31 | Transmission arrangement |
| 32 | Cam follower |
| 33 | Cam following |
| 34 | Rocker |
| 35 | Disk |
| 36 | Disk |
| 37 | Internal ring |
| 38 | Radial collar |
| 39 | Cone |
| 40 | Cutout |
| 41 | Locking means |
| 42 | Bolt |
| 43 | Tapped hole |
| 44 | Head |
| 45 | End |
| 46 | End |
| 47 | Clamping disk |
| 48 | Mounting means |
| 49 | (Screw) thread |

The invention claimed is:

1. Shaft transmission for a weaving machine, comprising;

a transmission frame, a shaft arrangement which is rotatably supported in the transmission frame and has at least one cam support section and one drive section, wherein these sections are separated from each other, a clutch arrangement provided between the cam support section and the drive section of the shaft arrangement, with said clutch arrangement rigidly connecting the cam support section and the drive section with each other in an engaged state, at least one cam disk, which engages a rocker for controlling the movement of a respective heald shaft, mounted on the cam support section, and a gear mechanism that comprises at least two gear wheels in meshing engagement with each other, and with one of the gear wheels being non-torsionally connected with the drive section of the shaft arrangement and the other of the gear wheels being non-torsionally connected with a drive shaft of a drive motor.

2. Shaft transmission in accordance with claim 1, wherein said clutch arrangement is located between the cam disk and the gearwheel which is connected to the drive section.

3. Shaft transmission in accordance with claim 1, wherein several cam disks, each engaging a rocker for controlling the movement of a respective heald shaft, are provided, with said cam disks forming a package which is detachably connected to the cam support section.

4. Shaft transmission in accordance with claim 1, wherein the drive section is associated with at least one bearing arrangement, and the clutch arrangement is located between the bearing arrangement and the cam disk.

5. Shaft transmission in accordance with claim 1, wherein the cam support section is associated with a bearing arrangement, and the cam support section is held in the bearing arrangement so as to be shiftable in an axial direction.

6. Shaft transmission in accordance with claim 1, wherein the clutch arrangement is a play-free friction clutch.

7. Shaft transmission in accordance with claim 1, the clutch arrangement is a cone clutch.

8. Shaft transmission in accordance with claim 1, wherein the clutch arrangement comprises a clamping means to secure the crutch arrangement in a clamped state.

9. Shaft transmission in accordance with claim 1, wherein the gear mechanism is a bevel gear transmission.

* * * * *